US012428767B2

(12) United States Patent
Bringewatt et al.

(10) Patent No.: US 12,428,767 B2
(45) Date of Patent: Sep. 30, 2025

(54) METHOD FOR PREPARING AND/OR MONITORING THE WET TREATMENT OF ITEMS OF LAUNDRY

(71) Applicant: Herbert Kannegiesser GmbH, Vlotho (DE)

(72) Inventors: Wilhelm Bringewatt, Lübbecke (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 128 days.

(21) Appl. No.: 18/415,262

(22) Filed: Jan. 17, 2024

(65) Prior Publication Data

US 2024/0240380 A1 Jul. 18, 2024

(30) Foreign Application Priority Data

Jan. 17, 2023 (DE) ..... 10 2023 101 049.2

(51) Int. Cl.

| | |
|---|---|
| ***D06F 34/05*** | (2020.01) |
| ***D06F 33/52*** | (2020.01) |
| ***D06F 34/18*** | (2020.01) |
| *D06F 37/12* | (2006.01) |
| *D06F 93/00* | (2006.01) |

(52) U.S. Cl.

CPC ..... *D06F 34/05* (2020.02); *D06F 33/52* (2020.02); *D06F 34/18* (2020.02); *D06F 37/12* (2013.01); *D06F 93/005* (2013.01)

(58) Field of Classification Search

CPC ..... D06F 34/05

See application file for complete search history.

(56) References Cited

FOREIGN PATENT DOCUMENTS

| | | | |
|---|---|---|---|
| DE | 28 38 183 | C2 | 3/1987 |
| DE | 102012001830 | A1 | 8/2013 |
| EP | 0440306 | A1 | 8/1991 |
| EP | 1 942 223 | A2 | 7/2008 |
| EP | 2159318 | A1 | 3/2010 |
| EP | 2 623 661 | B1 | 11/2020 |
| JP | 2019-058397 | A | 4/2019 |

*Primary Examiner* — Jason Y Ko

(74) *Attorney, Agent, or Firm* — Oliff PLC

(57) ABSTRACT

A method for preparing and/or monitoring the wet treatment of items of laundry wherein the items of laundry are counted using their electronic data carriers. An electronic data carrier of the item of laundry is determined. If more than a single electronic data carrier is detected, this indicates that there are multiple connected items of laundry which do not permit washing. The electronic data carriers can be used to determine the number of items of laundry loaded into a washing machine and the number of items of the same unloaded batch of laundry. If the unloaded batch of laundry has a lower number of electronic data carriers than during loading, this indicates that not all the items have been unloaded from the washing machine and there is a risk of the washing machine becoming blocked.

11 Claims, 1 Drawing Sheet

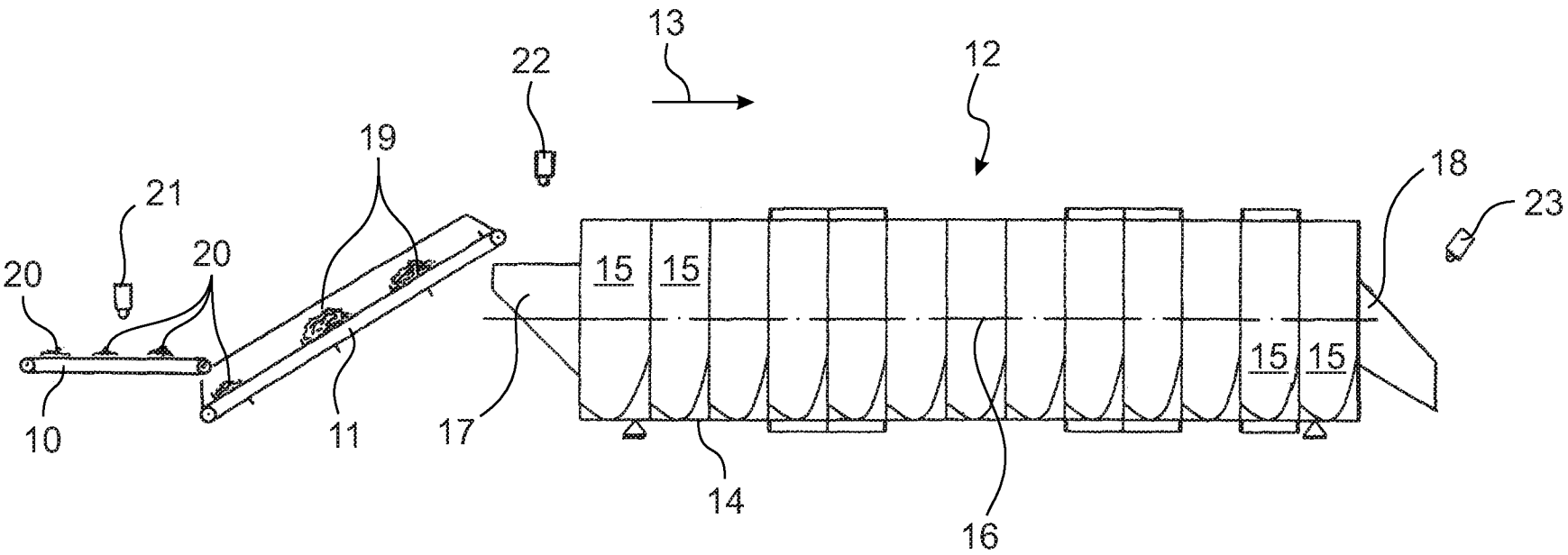
23
18
15
15
12
16
13
14
15
15
22
17
19
11
20
21
20
10

METHOD FOR PREPARING AND/OR MONITORING THE WET TREATMENT OF ITEMS OF LAUNDRY

The invention relates to a method for monitoring the wet treatment of laundry according to the pre-characterizing clause of claim 1. Furthermore, the invention relates to a method for preparing the wet treatment of items of laundry according to the pre-characterizing clause of claim 6.

Used items of laundry from the commercial sector in particular, for example hotels, restaurants or care facilities, are occasionally knotted together or other items of laundry (sheets, towels or similar) are contained in double-layered items of laundry, for example pillows or duvet covers. In the latter case, the pillows, duvet covers or other double-layer items of laundry are used as a kind of sack for other used items of laundry. In cases such as those described above, the items of laundry cannot be prepared for the actual wet treatment, such as washing, because they first have to be separated from each other. This is often not done for reasons of convenience. This can lead to problems during washing, but at the latest during subsequent treatments of the washed items of laundry, for example during drying, ironing and, above all, folding.

When multiple items of laundry are washed in batches in washing machines, it can happen that not all of the items of laundry that are washed in each batch are unloaded from the washing machine. This can lead to so-called blockages of items of laundry in the washing machine, especially if multiple consecutive batches of laundry are not completely unloaded. Such blockages have to be removed manually, which leads to longer interruptions in the operation of the washing machine.

The invention is based on the object of creating methods for preparing and/or monitoring the wet treatment of items of laundry, which avoid operational disturbances caused by connected items of laundry or items of laundry remaining in the washing machine during the wet treatment and/or the subsequent treatment.

A method for achieving the object comprises the measures of claim 1. Accordingly, it is intended to count the items of laundry before their treatment, in particular wet treatment, using their electronic data carriers. Such data carriers are electronic data storage devices or have electronic data storage devices.

In particular, when the washing machine is loaded or unloaded, the number of items of laundry in the respective batch to be washed is determined using the electronic data carriers and the number of items of laundry that is determined during loading is compared with the number of items of laundry that is determined during unloading. If this comparison reveals that the number of electronic data carriers that is determined during unloading is smaller than during loading, this indicates that not all of the items of laundry in the batch in question have been unloaded from the washing machine. Items of laundry then remain in the washing machine and they can lead to blockages in the washing machine when washing subsequent batches. This is particularly the case if connected items of laundry are left behind in the washing machine. According to the invention, impending blockages in the washing machine are thus recognized at an early stage with the aid of electronic data carriers of the items of laundry. As a result, countermeasures can be taken in good time and operating faults avoided.

In particular, the electronic data carriers of the items of laundry are used to check whether the number of items of laundry in a particular batch of laundry during unloading corresponds to the number of items of laundry in the same batch of laundry during loading. If the number of items of laundry is the same during loading and unloading, all items of laundry in the batch of laundry have been completely unloaded from the washing machine. Otherwise, a lower number of unloaded items of laundry in the batch of laundry indicates that not all the items of laundry in this batch of laundry have left the washing machine, i.e. at least one item of laundry has remained in the washing machine.

It is preferable that, both during loading and unloading of the washing machine, the electronic data carriers of the items of laundry, in particular of all items of laundry of the respective batch, are detected, preferably read and/or at least partially read out, by at least one reading device operating in a contactless manner by electromagnetic means, in particular by radio transmission.

In a preferred embodiment of the method, the contactless electromagnetic detection by the respective reading device by electromagnetic means and/or reading or at least partial reading of the electronic data carriers of the items of laundry takes place during loading and unloading of the washing machine in such a way that at least one value stored in the data carrier of the item of laundry is read out. The value can be an identification number of the electronic data carrier of the item of laundry, an identification number of the item of laundry, but also at least one other value of the electronic data carrier of the respective item of laundry. Alternatively, it is also conceivable that the respective electronic data carrier is detected or determined by the respective electromagnetic reading device only detecting a signal indicating the presence of the item of laundry and/or an electronic data carrier. Thanks to the aforementioned readout options for the electronic data carriers of the items of laundry, the number of items of laundry in the respective batch of laundry can be determined quickly and reliably in a contactless manner by electromagnetic means using their electronic data carriers during the loading and unloading process.

According to a special, advantageous possible embodiment of the method, if fewer electronic data carriers are detected during unloading than during loading, this is considered to be an incomplete unloading of the respective batch. In such a case, it is intended that a signal indicating incomplete unloading is generated. This can be a simple acoustic and/or optical signal. Alternatively or additionally, in the case of electronic control system and/or documentation of the washing process, the incomplete unloading can be stored in the control system and/or documentation. If identification features of the item of laundry or the electronic data carrier are detected, preferably read or read out, by the relevant reading device when they are determined, it is possible to document which item of laundry is missing and/or has remained in the washing machine.

It is also conceivable to use the quantity of unloaded items of laundry to decide whether the washing machine should be stopped immediately or whether it should wait to see whether the missing item of laundry leaves the washing machine when the next batch of laundry is unloaded. This procedure is particularly suitable if the difference in the number of electronic data carriers detected during loading and unloading is relatively small, for example if only a single item of laundry has not been unloaded or if a number of items of laundry to be individually defined as a limit value has not been unloaded. If, when the next batch of laundry is unloaded, the item or items of laundry left behind are unloaded with the next batch, no action needs to be taken. If a log is created during the washing process, the log can be used to determine which item of laundry has been carried over to a subsequent batch of laundry and has not been unloaded with the associated batches of laundry. The respective item of laundry must then be reassigned to the correct batch following the washing process. This is conveniently done during subsequent treatment of the washed items of laundry, which requires the items of laundry to be separated, i.e. the batch of laundry to be broken down. It is most practical to change the sequence when transporting the separated items of laundry onwards.

A method for preparing the wet treatment of items of laundry which is used to achieve the object has the features of claim 6. Accordingly, during the pre-treatment or in connection therewith, it is intended to count the items of laundry by means of their electronic data carriers. Such data carriers represent electronic data storage devices or have electronic data storage devices.

In particular, the electronic data carriers of the items of laundry are used to check whether, especially after separation, multiple items of laundry are connected, for example by multiple items of laundry being knotted together or at least one further item of laundry being contained in a double-layer item of laundry. If this is the case, such an item of laundry containing further items of laundry can be recognized and only fed to the intended treatment after being separated from each other. As a result, such connected items of laundry cannot cause any malfunctions during further treatment and/or lead to damage in subsequent laundry machines.

The method is based in particular on the inclusion of electrical data carriers, which can be read by reading devices in a contactless manner by electromagnetic means and/or by radio technology, in the preparation of the items of laundry for wet treatment. In the case of this method, it is advantageous to determine the number of electronic data carriers for each item of laundry. Normally, each item of laundry has a single electronic data carrier. This normal case is assumed in the following. However, it is also conceivable to provide the items of laundry with multiple electronic data carriers, wherein each item of laundry has the same number of electronic data carriers. The invention is therefore not limited to a single electronic data carrier per item of laundry.

If each item of laundry has a single electronic data carrier, the detection of multiple electronic data carriers indicates that it is not just one item of laundry, but multiple items of laundry. In this way, multiple interconnected items of laundry can be detected even if only a single item of laundry is optically recognizable because at least one further item of laundry is located, for example, in the double-layered item of laundry being used as a bag or multiple items of laundry are knotted together.

If, according to the method according to the invention, multiple electronic data carriers are detected in a visible item of laundry, this indicates the presence of multiple connected items of laundry which must not be treated together, in particular leading to problems during drying, ironing and/or folding after washing. Such problems can be prevented in that in the case of an item of laundry that is optically recognizable as a single item of laundry, but where the method according to the invention has determined that there are actually multiple items of laundry, these items of laundry are ejected together. Such items of laundry are then preferably separated from each other manually before they are subjected to the wet treatment. Once the excluded items of laundry have been separated, they do not need to be prepared again according to the method of the invention, in particular their electronic data carriers do not need to be determined.

It is preferable to determine before the initial treatment, in particular washing, whether an individual item of laundry has only a single electronic data storage device which can be detected in a contactless manner by electromagnetic means, preferably read out, or a plurality of electronic data storage devices. If multiple electronic data storage devices are detected, this indicates that the respective item of laundry, which can be optically perceived as a single item of laundry having an electronic data storage device, contains at least one further item of laundry having an electronic data carrier or is knotted to at least one further item of laundry having an electronic data carrier. If not just a single electronic data carrier is detected, in particular read out, but multiple electronic data carriers at the same time, this indicates multiple connected items of laundry that must not be treated in this way. Such items of laundry are then only fed for further treatment as individual items of laundry after they have been separated from each other, preferably manually.

An advantageous possible embodiment of the method provides for the items of laundry to be transported one after the other, preferably separated or at least pre-separated, along at least one preferably electromagnetic reading device for contactless detection of the electronic data carriers of the items of laundry. Preferably, the items of laundry are transported along the at least one reading device before their treatment or before their first treatment, in particular wet treatment. In this way, as the items of laundry pass the at least one electromagnetic reading device, the latter can continuously determine how many electronic data carriers the respective apparently individual and/or pre-separated item of laundry has. Only such an item of laundry for which the at least one reading device has detected only a single electronic data carrier is then fed to the further treatment, preferably the washing treatment to be carried out next, in particular wet treatment, as an actual single item of laundry. Other items of laundry can be ejected and subsequently treated.

The method according to the invention is characterized in particular by the fact that the number of electronic data carriers and thus also the number of items of laundry can be determined by contactless detection, in particular reading and/or reading out, of the electronic data carriers, and namely preferably during transport of the items of laundry to the first and/or next treatment. A number of data carriers in excess of the intended number of electronic data carriers per item of laundry indicates that the item of laundry, which can be optically perceived as a single item of laundry, is connected to at least one further item of laundry.

An advantageous possible development of the method provides for at least one value, preferably an identification number of the respective item of laundry or an identification number of the respective electronic data storage device of the item of laundry, to be detected in a contactless manner by electromagnetic means and/or wireless data transmission by reading the electronic data carrier of the respective item of laundry using at least one electromagnetic reading device. It is not absolutely necessary to read out all the values and/or data stored in the respective electronic data storage device in order to determine with sufficient reliability whether the respective item of laundry has only the intended single electronic data storage device or another intended number of electronic data storage devices or a larger number of electronic data storage devices, which indicates the presence of not only a single item of laundry, but at least one further hidden item of laundry which is invisibly located in a multi-layered item of laundry or is knotted to an item of laundry.

Preferred embodiments of the invention are explained in more detail below with reference to the drawing:

The single FIGURE of the drawing schematically shows a part of a treatment line for preparing and monitoring the wet treatment in items of laundry to a washing machine, but without subsequent laundry machines for further treatment of the washed items of laundry.

BRIEF DESCRIPTION OF THE DRAWINGS

The FIGURE depicts an apparatus for carrying out an embodiment of the invention.

The initial part of the treatment line shown in the FIGURE relates in particular to a washing line for items of laundry. A feed conveyor 10, a loading conveyor 11 and a washing machine are shown as examples in this FIGURE. The washing machine shown is a continuous washing machine 12. The feed conveyor 10, the loading conveyor 11 and the continuous washing machine 12 follow one another in the direction of treatment 13 of the items of laundry, and namely preferably interlinked.

The continuous washing machine 12 shown is used to wash the items of laundry in batches. For this purpose, multiple chambers 15 are formed in the elongated drums 14, following one another in the direction of treatment 13. Each chamber 15 is used to wash a batch of a plurality of items of laundry. The successive chambers 15 form a pre-wash zone, a clear wash zone and, if necessary, a rinse zone and/or after-treatment zone in the drum 14. Each of these zones can have a different number of chambers 15. Accordingly, the invention is not limited to the continuous washing machine 12 shown with thirteen successive chambers 15.

The continuous washing machine 12 can be driven in rotation about its longitudinal center axis 16, which thus simultaneously forms the axis of rotation of the cylindrical drum 14. Depending on the design of the continuous washing machine 12, the drum 14 is driven in a rotating or swiveling manner during treatment of the items of laundry, whereby the drum 14 only performs partial circle rotations in alternating opposite directions.

Each chamber 15 of the continuous washing machine 12 shown contains a batch of laundry. In the continuous washing machine 12 shown with thirteen successive chambers 15, thirteen batches of laundry are therefore treated simultaneously in the individual chambers 15, namely pre-washed, rinsed and, if necessary, rinsed and/or treated.

When the treatment of the items of laundry in the respective chamber 15 has been completed, each complete batch of laundry is simultaneously transferred to the next chamber 15 in the direction of treatment 13. For this purpose, the direction of rotation of the drum 14 is reversed or, if the drum is driven in a swiveling manner for reloading, the angle of rotation of the drum 14 is increased.

A loading hopper 17 is located upstream of the drum 14 and the first chamber 15 thereof and said loading hopper is used to load the first chamber 15 with the number of items of laundry required to form the next batch to be washed, in particular the batch of laundry.

An unloading chute 18 is located downstream of the drum 14 and the last chamber 15 thereof. A washed batch of laundry leaves the continuous washing machine 12, namely the last chamber 15 thereof, via the unloading chute 18.

The loading conveyor 11 is located upstream of the continuous washing machine 12. This loading conveyor 11 transports, for example, the piles of laundry 19 shown in the FIGURE in the direction of treatment 13 into the loading hopper 17, preferably in a slightly ascending direction corresponding to the direction of treatment. In addition, liquid can be fed into the first chamber 15 of the continuous washing machine 12 to submerge the piles of laundry 19. As many piles of laundry 19 as are required to form a batch of laundry with a corresponding number of items of laundry 20 are fed to the loading hopper 17 during each loading process of the continuous washing machine 12.

The feed conveyor 10 is used to feed individual items of laundry 20 at a short distance from one another in the initial area of the loading conveyor 11. Preferably, the loading conveyor 11 remains stationary until a pile of laundry 19 consisting of multiple individual items of laundry 20 has formed at the beginning of the loading conveyor 11. A sorting station, not shown in the FIGURE, for delivered used items of laundry 20 and/or a separating station for used items of laundry 20 is preferably provided upstream of the feed conveyor as viewed in the direction of treatment 13. It is also conceivable to arrange the feed conveyor 10 upstream of a sorting station.

The items of laundry 20 are those that have at least one electronic data carrier. For the following description, it is assumed that each item of laundry 20 has a single electronic data carrier. The data carrier may be a passive electronic chip, for example an RFID chip or a near-field chip (NFC). However, the invention is not limited to this. The decisive factor is that the data carriers can be read electromagnetically in a contactless manner. Each data carrier contains the information required for the treatment of the items of laundry 20 and preferably also information required for logistics, such as customer information. Furthermore, the data carrier can have its own identification feature and/or an identification feature of the respective item of laundry 20. The respective identification feature can be a consecutive number.

Three reading devices 21, 22 and 23 are shown in the FIGURE. The reading devices 21 to 23 are preferably of the same design. The reading device 21 is assigned to the feed conveyor 10 in such a way that it is located at a slight distance above the items of laundry on the feed conveyor. The reading device 22 is arranged above the loading hopper 17. Finally, the reading device 23 is located above the unloading chute 18 at the end of the continuous washing machine 12. It is also conceivable to provide multiple, possibly different, reading devices where a single reading device 21, 22 and 23 is shown in the drawing, in order to increase the reliability of the detection of the electronic data carriers of the items of laundry 20 and/or to speed up the reading, in particular the reading out, of the electronic data carriers. The reading devices 21, 22 and 23 may also be referred to and/or operate as electronic scanners, preferably radio scanners.

The reading devices 21, 22 and 23 detect, determine and/or read the electronic data carriers of the items of laundry 20 by electromagnetic means. As a result, the passive electronic data carriers, in particular chips, can be detected, determined and/or read in a contactless manner or wireless transmission.

The reading device 21 above the feed conveyor 10 is used to prepare items of laundry for wet treatment. In particular, they are used to determine whether the separated items of laundry 20 are connected to at least one further item of laundry 20, for example whether there is another item of laundry 20 in a bag-like double-layer item of laundry 20 and/or whether multiple items of laundry are firmly intertwined, for example by being knotted together.

The electronic reading devices 22 and 23 are used to monitor the wet treatment of items of laundry 20. In the exemplary embodiment shown in the FIGURE, the treatment process, preferably the loading and above all the unloading process, of the continuous washing machine 12 is monitored by the two reading devices 22, 23 arranged at the beginning and end of the continuous washing machine in order to detect at an early stage any blockages of items of laundry 20 which have become entangled in the continuous washing machine 12.

The method according to the invention is explained below with reference to the illustration and the FIGURE in the drawing described above:

Separated items of laundry 20 delivered to laundries are first pre-treated for subsequent treatment, in particular wet treatment and/or washing. Initially, the items of laundry 20 are sorted separately after delivery or immediately sorted and separated in the process. It is also conceivable that the items of laundry are only separated and not sorted after delivery if the items of laundry do not require sorting due to their nature and origin or have already been sorted.

It is sometimes the case that, above all, items of laundry from commercial areas such as hotels, restaurants, care facilities or similar, for example bed linen, towels and/or table linen, cannot be separated because multiple items of laundry 20 are knotted together, connected in some other way or are in double-layered items of laundry such as duvets or pillowcases of other items of laundry 20. In this case, a supposedly separate item of laundry 20 consists of two or more than two items of laundry 20. This can lead to serious problems such as malfunctions and even damage to the laundry machines during washing, but also during subsequent treatments such as drying, ironing and/or folding.

According to the invention, when the items of laundry 20 are prepared for wet treatment, in particular washing, their electronic data carriers are used to check beforehand whether the respective separated item of laundry 20 separated in each case is really a single item of laundry 20 or at least one further item of laundry 20. In the latter case, this indicates that there are multiple items of laundry 20 or that at least one further item of laundry 20 is accommodated in a double-layer duvet cover or pillowcase.

The electronic reading device 21 is used to determine in a contactless and wireless manner whether the one item of laundry 20 transported past the reading device 21 has only a single electronic data carrier or whether multiple electronic data carriers are detected and/or determined by the electromagnetic reading device 21 in connection with this item of laundry 20. If this is the case, it is not a matter of a separated single item of laundry 20, but of multiple items of laundry 20 which are connected to one another in such a way that they can be automatically detached from one another when they are separated.

If the electromagnetic reading device 21 detects more than one electronic data carrier in items of laundry 20 that are transported past it individually, these are multiple connected and/or interconnected items of laundry 20 that are not suitable for further treatment, in particular wet treatment, and therefore should and/or must not enter the continuous washing machine 12. Such interconnected items of laundry 20, which have been identified by the simultaneous detection of multiple electronic data carriers by the reading device 21, are then ejected upstream of the continuous washing machine 12. This can be achieved, for example, by pushing the item of laundry 20 laterally down from the feed conveyor 10, but also by selectively gripping and conveying the item of laundry 20, which is connected to at least one further item of laundry 20, away from the feed conveyor 10.

In the case of the continuous washing machine 12 shown in the FIGURE, the method for monitoring the wet treatment, preferably washing, is carried out by wireless and contactless detection of the number of electronic data carriers of the respective batch of laundry. The number of electronic data carriers of the respective batch of laundry is determined by the electromagnetic reading device 22 during loading of the continuous washing machine 12 and during unloading of the continuous washing machine 12 by the electromagnetic reading device 23 arranged downstream of it, which also determines the number of electronic data carriers of the same unloaded batch of laundry in a contactless and wireless manner. In the case of one electronic data carrier per item of laundry 20, the number of electronic data carriers of the respective batch determined by the reading device 22 upstream of the continuous washing machine 12 and the reading device 23 downstream of the continuous washing machine 12 corresponds to the number of items of laundry 20 in this batch.

By comparing the number of items of laundry of a respective batch of laundry when loading the continuous washing machine 12 and the number of items of laundry 20 of the same batch of laundry when unloading the continuous washing machine 12, it can be determined whether a batch of laundry and/or which batch of laundry has left the continuous washing machine 12 completely or incompletely after washing. For example, if the reading device 22 upstream of the continuous washing machine 12 determines that a certain batch of laundry has seventy-five electronic data carriers and, after washing this batch of laundry, the reading device 23 downstream of the continuous washing machine 12 determines that the same batch of laundry only contains seventy-two electronic data carriers, this is an indication that three electronic data carriers, i.e. three items of laundry, have remained in the continuous washing machine 12 and/or that the batch of laundry has not completely left the continuous washing machine 12 after washing with all items of laundry 20, in this example seventy-five items of laundry 20.

If the incomplete unloading of a batch of laundry is detected, there are various ways of proceeding:

If the unloaded batch of laundry is only missing a few items of laundry 20, the number of which can be defined as a limit value individually or according to detection values, it is possible to wait to see whether the reading device 23 has detected a greater number of electronic data carriers in the next unloaded batch of laundry than this batch of laundry originally had when it was loaded. If all the items of laundry 20 missing from the previous batch (three items of laundry 20 in the aforementioned example) were then unloaded with the next batch of laundry, no individual items of laundry 20 remained in the continuous washing machine 12. If, on the other hand, the reading device 23 downstream of the continuous washing machine 12 detects that the unloaded batch of laundry is missing a number of electronic data carriers exceeding a predetermined limit value, which indicates that a very large number of items of laundry 20 have been left behind in the continuous washing machine 12, an optical and/or acoustic signal can be generated to indicate to the machine operator that too many items of laundry 20 have not been unloaded. Based on this signal, the machine operator can then stop the continuous washing machine 12 before it becomes blocked. It is also conceivable that if there are too many items of laundry 20 left in the continuous washing machine 12, this is transmitted to the control system of the continuous washing machine 12, which then automatically stops the continuous washing machine 12. In particular, the control system then indicates to the machine operator that the continuous washing machine 12 has been stopped due to a blockage or imminent blockage of the drum 14 caused by items of laundry 20 remaining therein.

The invention is also suitable for other machines for the wet treatment of items of laundry comprising electronic data carriers. The invention is also not limited to the continuous washing machine 12 shown in the FIGURE. The invention is also suitable for other washing machines and washer extractor machines having a drum which can be driven in rotation and currently only accommodates one batch of laundry. In such washing machines, loading and unloading takes place through a closable opening in an end face or drum shell. In this case, it may be sufficient if only one electromagnetic reading device is assigned to the opening in the drum, first determines the number of electronic data carriers of each item of laundry and thus the number of items of laundry 20 forming this item during loading of the drum and then determines the number of items of laundry 20 during unloading on the basis of their electronic data carriers.

The above-described exemplary embodiment of the invention relates both to the preparation of the items of laundry 20 for wet treatment and to the monitoring of the items of laundry 20 during wet treatment, whereby protection is claimed for the preparation and the monitoring in combination. However, protection is also claimed only for the preparation of the items of laundry and/or only for the monitoring of the items of laundry during wet treatment with, in particular, washing machines of various types.

LIST OF REFERENCE SIGNS

10 Feed conveyor
11 Loading conveyor
12 Continuous washing machine
13 Direction of treatment
14 Drum
15 Chamber
16 Longitudinal center axis (axis of rotation)
17 Loading hopper
18 Unloading chute
19 Pile of laundry
20 Item of laundry
21 Reading device
22 Reading device
23 Reading device

The invention claimed is:

1. A method for monitoring the wet treatment of items of laundry, wherein batches are formed from a plurality of items of laundry, each of which has at least one electronic data carrier, and the items of laundry of the respective batch are at least washed together in a washing machine, wherein during loading and unloading of the washing machine, the number of items of laundry of the respective batch is determined by means of their electronic data carriers and the number of items of laundry that is determined during loading is compared with the number of items of laundry that is determined during unloading.

2. The method as claimed in claim 1, wherein both during loading and unloading of the washing machine, the electronic data carriers of all items of laundry of the respective batch are determined, detected and/or read out in a contactless manner by at least one electromagnetic reading device.

3. The method as claimed in claim 1, wherein at least one value is read out in a wireless and contactless manner from the electronic data carriers of the items of laundry of the respective batch detected during loading and unloading by the at least one electromagnetic reading device.

4. The method as claimed in claim 1, wherein the number of electronic data carriers of the items of laundry of each batch of laundry during loading of the washing machine and the number of electronic data carriers of the items of laundry of the same batch of laundry during unloading of the washing machine are determined by at least one reading device upstream and downstream of the washing machine.

5. The method as claimed in claim 1, wherein, if the at least one electromagnetic reading device detects a different number of electronic data carriers of the same batch of laundry during unloading than during loading of the washing machine, a signal indicating incomplete unloading of the batch of laundry in question is generated.

6. A method for preparing the wet treatment of items of laundry, wherein the items of laundry each having at least one electrical data carrier are checked to see whether they contain at least one other item of laundry or are connected to at least one other item of laundry, wherein the number of electronic data carriers is determined for each item of laundry.

7. The method as claimed in claim 6, wherein, by detecting the electronic data carriers, it is determined whether at least one further item of laundry is connected to an item of laundry.

8. The method as claimed in claim 6, wherein it is determined by detecting the electronic data carriers whether and how many items of laundry are interconnected.

9. The method as claimed in claim 6, wherein the items of laundry are transported one after the other along at least one electromagnetic reading device for contactless and wireless detection of the electronic data carriers of the items of laundry.

10. The method as claimed in claim 6, wherein at least one value is determined in a contactless and wireless manner by electromagnetic means by reading the electronic data carrier of the respective item of laundry by the at least one electromagnetic reading device of the same.

11. The method as claimed in claim 6, wherein the simultaneous detection of multiple readable electronic data carriers when a respective separated item of laundry is moved past the at least one reading device is evaluated as an item of laundry which is interconnected to at least one further item of laundry and which must first be separated from at least one connected item of laundry by an additional treatment before the intended treatment.

* * * * *